United States Patent [19]

Leffler

[11] 4,053,353

[45] Oct. 11, 1977

[54] METHOD OF CONTROLLING BASIS WEIGHT OF A CYLINDER BOARD MACHINE

[75] Inventor: Nils Leffler, Mountain View, Calif.

[73] Assignee: Measurex Corporation, Cupertino, Calif.

[21] Appl. No.: 648,655

[22] Filed: Jan. 13, 1976

Related U.S. Application Data

[63] Continuation of Ser. No. 499,455, Aug. 22, 1974, abandoned.

[51] Int. Cl.[2] ..... D21F 1/06; D21F 1/08

[52] U.S. Cl. ..... 162/198; 162/253; 162/258; 162/259; 162/DIG. 6; 162/DIG. 11

[58] Field of Search ..... 162/198, 252, 253, 254, 162/258, 259, 263, DIG. 6, DIG. 11

[56] References Cited

U.S. PATENT DOCUMENTS

| | | | |
|---|---|---|---|
| 3,650,891 | 3/1972 | Dahlin | 162/259 |
| 3,661,701 | 5/1972 | Al-Shaikh | 162/263 X |
| 3,703,436 | 11/1972 | Rice | 162/198 |
| 3,711,687 | 1/1973 | Stout et al. | 162/259 |
| 3,711,688 | 1/1973 | Stout et al. | 162/258 |
| 3,847,730 | 11/1974 | Doering | 162/198 |

OTHER PUBLICATIONS

Roberts, "Some Plain Talk on Digital Computers," Pulp and Paper, Aug. 12, 1968, pp. 32–37.

*Primary Examiner*—S. Leon Bashore
*Assistant Examiner*—Steve Alvo
*Attorney, Agent, or Firm*—Flehr, Hohbach, Test, Albritton & Herbert

[57] ABSTRACT

A method for the control of basis weight of a sheet material made from liquid stock controls the consistency of liquid stock flowing to a flow box by a consistency feedback loop, and varies the level of liquid stock in the flow box to effect a change in the flow of dry fiber to the sheet former. Level is maintained in a midrange and any level called for outside of midrange is handled by adjusting consistency.

4 Claims, 5 Drawing Figures

METHOD OF CONTROLLING BASIS WEIGHT OF A CYLINDER BOARD MACHINE

This is a continuation of application Ser. No. 499,455 filed Aug. 22, 1974 and now abandoned.

BACKGROUND OF THE INVENTION

The present invention is directed to a method of controlling the basis weight of a sheet material being manufactured from a liquid stock having a highly variable consistency or having an open stock tank.

There are many sheet products made from a liquid stock. Examples are: paper, various grades of paper board, asbestos roofing, gasketing, and ceiling tile. The machines used to make these products have a sheet forming apparatus to which a slurry of fiber and water is supplied. The water drains away and leaves a fiber sheet material. The fiber water slurry, often called liquid stock, is applied to the sheet former at a closely controlled rate. This is accomplished by allowing the stock to flow out of a tank at a certain speed which is, of course, dependent upon the total head in the tank. In many instances, the tanks are closed and the head is controlled by maintaining the liquid at a constant level and varying the air pressure above the liquid. However, in some instances, the tanks are open and the pressure or total head is determined by varying the level of liquid. With an open tank arrangement, the level is maintained by a variable overflow gate valve. However, this is unsatisfactory in that the gate is difficult to adjust even manually and close to impossible to adjust by automatic means.

In some installations, the percentage of fiber in the water, typically called consistency, varies widely when the level in the tank gets below a critical level. When this happens, the process becomes very difficult to control and the finished product is of poor quality. There are some installations where the consistency is constant, and the tank is closed but where there is no flowmeter on the stock lines supplying the tank. In these situations, current techniques for controlling the process, such as by estimating the flowrate in the stock line by measuring the valve setting, have proven to be very unsatisfactory.

Finally, as discussed above, because of the large variation in consistency, it is also desirable to automatically control consistency.

OBJECTS AND SUMMARY OF THE INVENTION

It is, therefore, an object of the present invention to provide an improved method for controlling the basis weight of a sheet material being manufactured from a liquid stock.

In accordance with the above object, there is provided a method of controlling the basis weight of a sheet material being manufactured from a liquid stock which passes through a flow box to a sheet forming device. In the flow box, the liquid stock is characterized by having variable consistency and level. Level and consistency are key determinants of the basis weight of the sheet material. The steps of the method include the following. The level of the liquid stock is measured in the flow box. The basis weight of the sheet material is measured and compared to a desired target to provide a basis weight error control signal which determines the change in level target needed. The measured level is compared to the target and controlled to minimize any comparison error. The consistency is measured and controlled to a consistency target. Upper and lower limits of the level are predetermined and any level target called for in excess of the limits causes the level target to be moved in a direction away from the limit. The consistency target is modified in an inverse manner to the level target to prevent any upset in basis weight.

DETAILED DESCRIPTION OF THE PREFERRED EMBODIMENT

The invention is applicable to cylinder board type machines, inverformer type machines, and other machines for manufacturing a sheet material from a liquid stock. A preferred embodiment of the present invention will be described in connection with a cylinder board machine where the previously referred to tank is known as a flow blox and the sheet forming operation is performed in vats.

Figure 1:
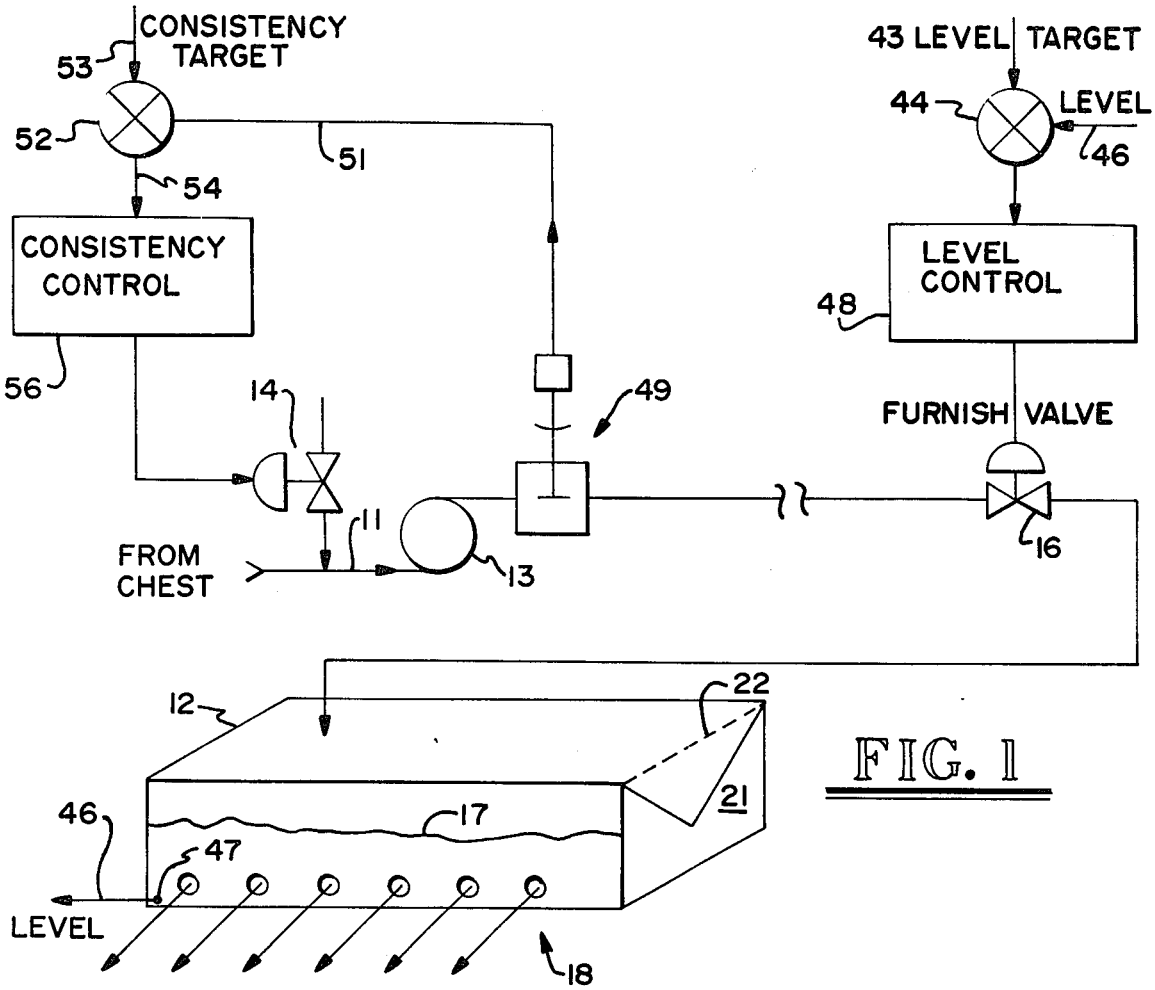
FIG. 1 is a block diagram showing a portion of both the hardware and control units used in the method of the present invention.
Figure 2:
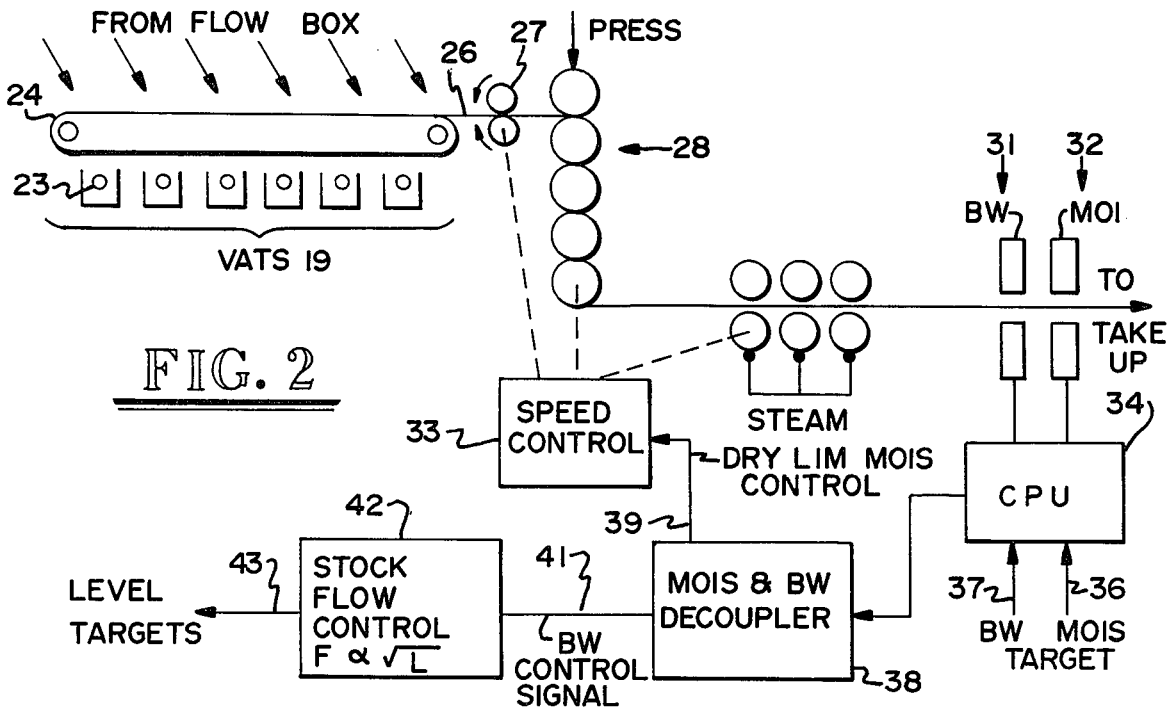
FIG. 2 is a continuation of the hardware of FIG. 1 and also shows additional control units.

From a hardware standpoint, FIGS. 1 and 2 illustrate a typical cylinder board machine. A slurry of water and fiber is premixed in several chests (not shown) to form a thick stock which is supplied via line 11, and stock pump 13 to an open flow box 12. The consistency of the liquid stock is controlled by a water valve 14 which provides dilution water. Furnish valve 16 controls the amount of liquid stock flowing into the stock flow box 12 and, therefore, the level 17 of liquid stock in the flow box. The bottom portion of the flow box includes several pipes 18 which continuously fill vats 19 as illustrated in FIG. 2. The rate of stock flow from the pipes 18 is determined by the level of liquid stock in the flow box in accordance with well-known flow theory; namely, the velocity of the stock flow is proportional to the square root of the level. Flow box 12 also includes an overflow gate 21 but as will be discussed below in accordance with the invention, the gate is permanently fixed in its fully closed position as indicated by the dashed line 22. In other words, with the control techniques of the present invention no overflow need be accommodated. An underflow is used to keep satisfactory circulation in the box.

Referring to FIG. 2 specifically, the vats 19 each include a roller 23 which in conjunction with the rotating wire 24 forms a moving sheet material 26. The material first passes through rollers 27, is then woven through press rollers 28 which press may be varied to control thickness. Thereafter, the sheet passes through drier section 29 which is supplied with a source of steam. Near the end of the process, basis weight and moisture gauges 21 and 32 of the scanning type measure these respective values of the sheet material before the material is out or taken up for shipment.

A speed control unit 33 controls the basic speed of the sheet material and is coupled to rollers 27, press rollers 28 and a dryer section 29.

Basis weight, measured weight per unit area, is probably the most important parameter by which the subject materials are bought and sold. Its accurate control is very important. The objective in controlling basis weight is to cause the measured basis weight to stay as close as possible to its target value.

Basis weight is, of course, principally determined by the flow rate of dry fiber into the sheet former — in this case vats 19. Dry fiber flow is determined by the flow rate of stock from flow box 12 times the consistency of the stock. Thus, both consistency and flow from the flow box must be controlled.

A feedback control loop is provided for control of consistency by a consistency meter 49 which provides an on-line measurement of consistency as a signal 51 which is compared at 52 with a consistency target signal 53. The error signal 54 is coupled to consistency control unit 56 which controls water valve 14 in a manner to minimize consistency error.

Flow is controlled by varying the level in flow box 12 according to well known physical principles. Thus, if consistency is normally held constant, basis weight may be accurately controlled by varying the level in flow box 12. According to the present invention, this is achieved by disabling the conventional variable overflow gate and utilizing a differential pressure cell or a level transmitter to detect the actual level in the flow box. With an accurate means of measuring the head, it is possible to accurately control the flow box level to a desired set point. Referring to FIG. 1, a level target 43 is compared at 44 with the measured level output 46 from a differential pressure cell 47 located at the bottom of flow box 12. The error signal, therefore, is supplied to level control unit 48 which controls furnish valve 16. The opening of the furnish valve is, of course, directly proportional to the level 17 of the flow box.

With this arrangement, basis weight may be controlled by varying the level target to reduce any basis weight error. Referring to FIG. 2, a measured basis weight signal is supplied from gauge 31 and is compared at 34 with a basis weight target 47. Any difference between the measured basis weight and the target basis weight is a basis weight error. A signal representing the signal is supplied from unit 34 to moisture decoupler 38 where the coupling effects of moisture and basis weight are removed. Decoupler 38 supplies a basis weight control signal to stock flow control unit 42 which determines the change in level target necessary to eliminate the basis weight error.

In actual practice, a basis weight error causes the level target to change by some incremental value. The effect of this change is detected by basis weight gauge 31 which will reduce the error, but may not eliminate it. It this happens, the level target will be incremented again. This process is repeated until the basis weight error is reduced to zero.

As discussed above, because of the nature of the flow box 12, even with the above closed loop control systems for consistency and level, it is undesirable to allow the level 17 in the flow box 12 to either exceed an upper limit where overflow might occur and thus produce an uncontrollable process or a lower limit where nonhomogeneous conditions occur and where measurement of the level or head by differential pressure cell 47 or level transmitter is not feasible or at the least unreliable. At low levels, of course, consistency would be very, very nonuniform. Thus, in accordance with the invention, a midrange control system is provided as graphically indicated in FIG. 3 where the level of, for example, a flow box of 24 inches in depth, has an upper level limit (UL) of 20 inches and a lower level limit (LL) of 5 inches. These are, of course, merely typical dimensions. A typical level variation curve 57 is illustrated and when the lower level is reached the midrange control is activated to thus control the level of stock back to a lower midranging level (LML) where such control stops. Control is started again when the upper level (UL) is reached and again stopped at an upper midrange level (UML).

Figure 4:
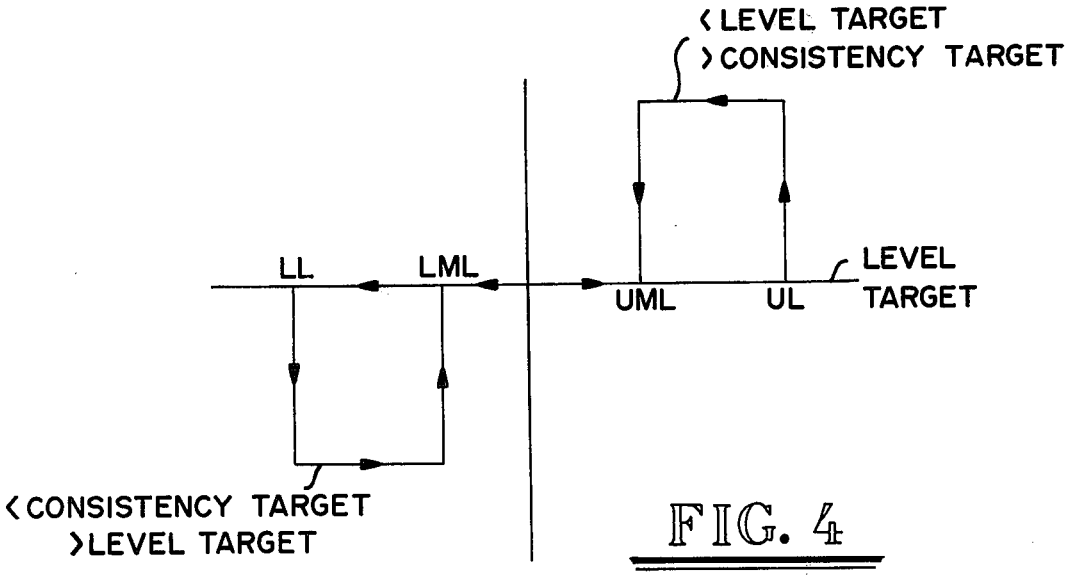
FIG. 4 is a diagram useful in understanding FIG. 3.

Conceptually, when the curve 57 is decreasing toward the lower level, the speed of the sheet material is being reduced, for example, necessitating less stock. Thus, when the lower level limit is reached, in order to increase the level, the level of target must be increased with a corresponding decrease in consistency. These control actions are better illustrated in the control diagram of FIG. 4 where it is apparent that the control actions are initiated at the LL and UL points with the indicated variations of the level target away from the limit in an opposite direction; that is, levels are brought back to either the LML or UML to a normal midrange control situation. At the same time, the consistency target is varied in an opposite manner to prevent any upset in basis weight.

Figure 5:
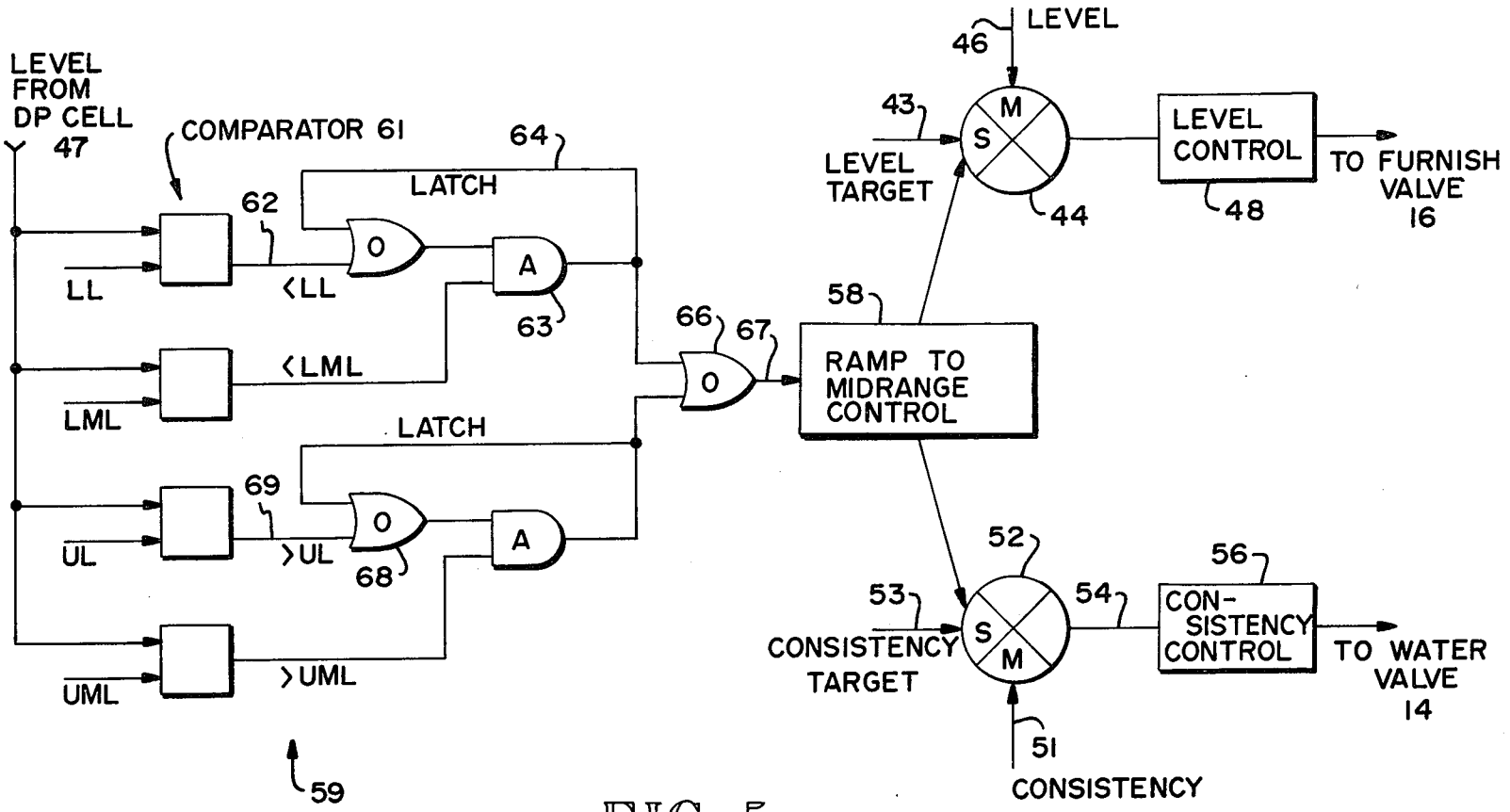
FIG. 5 is a logic diagram embodying a method of the present invention.

The specific technique for varying the consistency and level targets is shown in FIG. 5 where a ramp to midrange control unit 58 modifies both the level target 43 and the consistency target 53 as indicated in opposite directions to prevent any upset in basis weight but yet bring the level back to midrange. The ramp from unit 58 is produced by the logic 59 which in essence implements the control diagram of FIG. 4. Logic may be implemented by hardware or software. In the preferred embodiment the central processing unit 34 of FIG. 2 would accomplish such logic.

Figure 3:
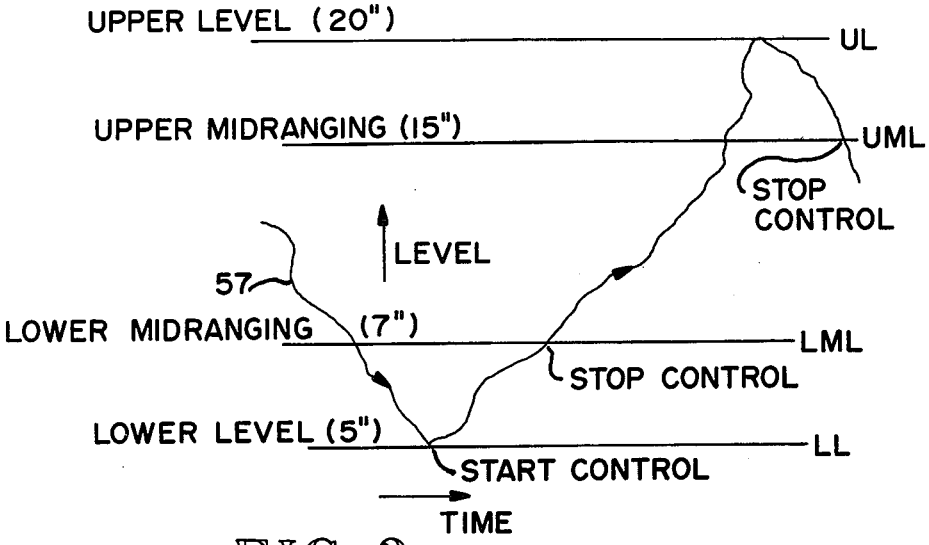
FIG. 3 is a diagram useful in understanding the invention.

Referring specifically to the logic 59, four comparators 61 have as inputs the various levels indicated in FIG. 3 which are compared with the measured level from differential pressure cell 47. If the level decreases below the lower level LL and an output occurs on line 62 and closes the AND gate 63 since by definition the level is also less than LML. Latching action occurs on line 64 to cause a continuous output through OR gate 66 on line 67. When the appropriate control action has taken place and the level passes through the lower midranging level (LML), AND gate 63 opens stopping the control action. The same is true of the upper level portion of the control logic utilizing OR gate 68 which receives a signal on line 69 when the level exceeds the upper level.

When moisture is controlled by the drier limited technique, the drier section 29 runs at its maximum setting and moisture is controlled by varying speed and stock. This, of course, affects the basis weight. Specifically, moisture is measured by the scanning gauge 32, and compared to a moisture target input 36 in comparator 34. Comparator 34 also has a basis weight target input on line 37. The error between the measured moisture and moisture target is coupled to the moisture and basis weight decoupler unit 38 which provides a "dry lim" control signal on line 39 to speed control unit 33 and stock control unit 42. The decoupler 38, now well-known in the art, in effect decouples the effect of an adjustment in one parameter from the other. For example, assume that a moisture measurement indicates that moisture must be increased to reduce the moisture error. This is done by adjusting the flow of liquid stock to the sheet former; but this adjustment increases both moisture and basis weight. However, decoupler unit 38 would also increase the speed of the machine which would decrease the basis weight without affecting the moisture. Thus, the process coupling between moisture and weight is eliminated.

In the case of prior closed flow box systems, total head consists of liquid level plus the air pressure above the liquid. The total head determines the flow rate to the sheet former and is controlled by changing some combination of the air pressure and liquid level. For example, when the liquid level get critically low, a vacuum is drawn in the space above the liquid to raise the level.

With the present invention, when the level reaches the critical limits, consistency is modified and the level moved away from the limit valve.

Thus, with the use of control loops for control of the level in the stuff box and consistency control in conjunction with a midrange control, an improved method of controlling the basis weight of a cylinder board machine has been provided.

I claim:

1. A method of controlling the basis weight of a sheet material manufactured from a variable consistency liquid stock in a machine having a sheet former and a flow box from which liquid stock is supplied to said sheet former said flow box having predetermined upper and lower limits of the level of liquid stock said method comprising: measuring said level of liquid stock in said flow box; measuring the basis weight of said sheet material and comparing said basis weight to a desired target to provide a basis weight error control signal; deriving a level target from said basis weight error control signal, comparing said measured level to said level target, and controlling said level by controlling the flow of said liquid stock to minimize any error in basis weight; measuring said consistency on an on-line basis of said liquid stock being supplied to said flow box and controlling said consistency to a normally constant consistency target by regulation of water added to said liquid stock; comparing said derived level target to said predetermined upper and lower limits of said level; when said derived level target reaches one of said limits modifying said level target in a direction away from the limit reached, and modifying said consistency target only in response and correspondingly to said level target modification to prevent any upset in basis weight.

2. A method as in claim 1 where when said lower limit is reached, the level target is increased and the consistency target decreased.

3. A method as in claim 1 where when said upper limit is reached, the level target is decreased and the consistency target increased.

4. A method of controlling the basis weight of a sheet material manufactured from a variable consistency liquid stock in a machine having a sheet former and a tank having a variable level of said stock and said tank being closed, with air pressure from an external source being provided, from which liquid stock is supplied to said sheet formed, said method comprising: meansuring the total head of liquid stock in said tank, said total head consisting of the liquid level and the air pressure above said liquid; measuring the basis weight of said material and comparing said basis weight to a desired target to provide a basis weight error control signal; deriving a total head target from said basis weight error control signal, comparing said measured total head to said total head target, and controlling said level by controlling the flow of said liquid stock to minimize any error in basis weight measuring said consistency on an on-line basis of said liquid stock being supplied to said flow box and controlling said consistency by regulation of water added to said liquid stock to a normally constant consistency target; comparing said derived head target to predetermined upper and lower limits of said target; when said derived level target reaches one of said limits modifying the head target in a direction away from said limit reached, and modifying said consistency target only in response and correspondingly to said head target modification to prevent any upset in basis weight.

* * * * *